US008458865B1

(12) United States Patent
Williams

(10) Patent No.: US 8,458,865 B1
(45) Date of Patent: Jun. 11, 2013

(54) YARD BAG CLIP

(76) Inventor: Kevin Williams, Cranston, RI (US)

( * ) Notice: Subject to any disclaimer, the term of this patent is extended or adjusted under 35 U.S.C. 154(b) by 0 days.

(21) Appl. No.: 09/418,081

(22) Filed: Oct. 14, 1999

(51) Int. Cl.
*B65B 67/04* (2006.01)
*B65D 33/02* (2006.01)

(52) U.S. Cl.
USPC ..... 24/555; 24/30.5; 24/545; 24/336; 248/97; 248/99; 294/1.1

(58) Field of Classification Search
USPC ..... 24/555, 545, 30.5, 336; 294/1.1; 248/97, 248/99
See application file for complete search history.

(56) References Cited

U.S. PATENT DOCUMENTS

| | | | | | |
|---|---|---|---|---|---|
| 265,171 | A | * | 9/1882 | Sperry | 24/545 |
| 2,279,460 | A | * | 4/1942 | Harter | 24/545 |
| 2,375,374 | A | * | 5/1945 | Lepp | 24/555 |
| 4,318,521 | A | | 3/1982 | Martin | 248/99 |
| 4,548,372 | A | | 10/1985 | Lutzker | 248/99 |
| 4,560,828 | A | * | 12/1985 | Franckx et al. | 24/545 |
| 4,615,743 | A | | 10/1986 | Bylenga | 134/6 |
| 4,846,427 | A | | 7/1989 | Jones | 248/95 |
| 5,163,278 | A | | 11/1992 | Martenhoff | 56/473 |
| 5,181,297 | A | * | 1/1993 | Andrews, Jr. et al. | 24/555 |
| 5,285,988 | A | | 2/1994 | Bogren | 248/95 |
| 5,454,535 | A | | 10/1995 | Thomson | 248/99 |
| 5,743,651 | A | | 4/1998 | Steinmetz | 383/33 |
| 5,884,454 | A | | 3/1999 | Steinmetz | 53/459 |
| 5,899,419 | A | | 5/1999 | Ross et al. | 248/990 |
| 6,135,518 | A | * | 10/2000 | Holthaus | 294/1.1 |

FOREIGN PATENT DOCUMENTS

| | | | | |
|---|---|---|---|---|
| FR | 0903736 | * | 10/1945 | 24/545 |

* cited by examiner

*Primary Examiner* — Victor Sakran

(57) ABSTRACT

A paper yard bag 28 securing device consisting of a cylindrical shape adapted to fit over the corners of two or more bags 28. Two cross-sectional cuts 20*a* and 20*b* form four symmetrical legs 14*a*, 14*b*, 14*c*, and 14*d* and a body 12. Each of the four legs 14*a*, 14*b*, 14*c*, and 14*d* has a convex radius 18*a*, 18*b*, 18*c*, and 18*d* facilitating the easy insertion of a group of corners of two or more bags 28. This mechanism serves to both maximize the opening of the bags 28 and secure a plurality of bags 28 adjacent to one another greatly reducing the time to fill yard waste.

2 Claims, 3 Drawing Sheets

YARD BAG CLIP

BACKGROUND

1. Field of Invention

This invention relates to plastic clips, specifically to such clips which are used for maximizing the opening of and securing a plurality of paper yard bags adjacent to one another.

2. Description of Prior Art

Due to the increase of environmental awareness and the necessity for biodegradable waste materials, paper yard bags have become very popular for disposing of yard waste. Leaves, twigs, grass, and many other forms of yard debris are commonly disposed of in these bags as they are completely biodegradable. In some cities and towns, it is mandatory that they be used for composting yard waste.

In addition, these paper yard bags greatly outperform the flexible plastic bags for several reasons. First of all, the paper yard bags are sturdy and stand up on their own while the plastic bags do not. Second, twigs will poke though plastic, but not through the durable paper bags. Third, paper yard bags are less costly to use for municipalities because they do not have to separate the waste from the bag for composting like they do with plastic.

There are disadvantages to the paper yard bags, however. Without a mechanism for holding them open, they are difficult to fill for several reasons:

(a) They have gusseted sides to facilitate folding, which forces them to taper inward at the top while open and standing. This small opening yields a very restricted fill area.

(b) The user must use one hand to hold open the bag, which greatly reduces efficiency. In this case, the user can only hold enough waste that will fit in their freed hand, which is significantly less than that which can be scooped up with a rake or garden tool. This makes the process very time-consuming. It is also very difficult to hold open the bag while manipulating a garden tool with the other freed hand in order to scoop the waste for filling.

(c) Due to the constricted opening of a single paper yard bag, the majority of the waste falls outside the opening onto the ground. The user must now rehandle the yard waste that was already scooped and attempt to fill again. This slow and inefficient process is very frustrating for the user as well as counterproductive to accomplishing the task.

Prior inventions involve very large and awkward units that hold open a single yard bag—for example U.S. Pat. Nos. 04,318,521 (1982) to Martin, 04,548,372 (1985) to Lutzker, and 05,454,535 (1995) to Thomson. They are generally inserted into the bag or serve as a standing frame-like apparatus, making for a clumsy execution. Due to significant set-up and disassembly time, these units offer very little in terms of reducing the time to complete the task.

Since they're designed to accommodate a single bag, they are very limiting in the amount of waste that can be collected at any given moment, which also adds time to complete the task. Furthermore, most of these units are designed to support flexible plastic bags, not paper yard bags.

OBJECTS AND ADVANTAGES

Accordingly, several objects and advantages of my invention are:

(a) to provide a means of maximizing the opening of paper yard bags to facilitate efficient filling with yard waste;

(b) to provide a means for tightly securing a plurality of paper yard bags adjacent to one another resulting in a much larger space for filling, which prevents the waste from falling outside the opening onto the ground;

(c) to provide a means for freeing both hands to scoop leaves and yard waste with a rake or other garden tool, which eliminates painful bending and inefficient hand-filling;

(d) to provide a means for filling significantly more waste at one time greatly reducing the time and energy required to collect the yard waste;

(e) to provide a much more enjoyable and efficient experience for the user.

Further objects and advantages are to provide a convenient, fast, easy-to-use, and damage-free method of filling paper yard bags, which is lightweight, small in size, simple, and inexpensive to manufacture, and which is reusable and durable. Still further objects and advantages will become apparent from a consideration of the ensuing description and drawings.

DRAWING FIGURES

Figure 1:
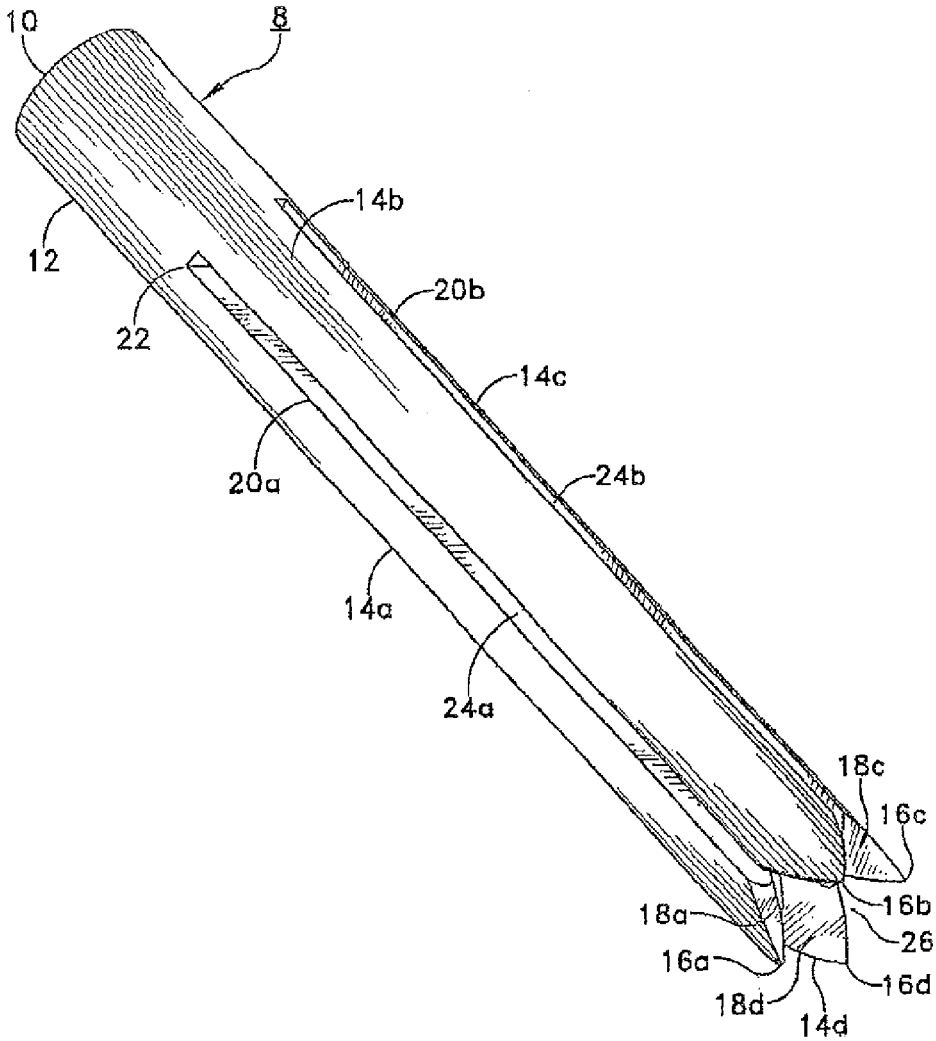
FIG. 1 is a perspective view of the yard bag clip.

| Reference Numerals In Drawings | |
|---|---|
| 8 | yard bag clip |
| 10 | top |
| 12 | body |
| 14 a, b, c, d | legs |
| 16 a, b, c, d | leg points |
| 18 a, b, c, d | convex radius of leg |
| 20 a, b | cross-sectional cuts |
| 22 | end of cross-sectional cuts |
| 24 a, b | leg spaces |
| 26 | bottom |
| 28 | paper yard bag |

SUMMARY

In accordance with the present invention, a yard bag clip comprises an elongated shape of a body with four symmetrical legs for securing paper yard bags.

Figure 3:
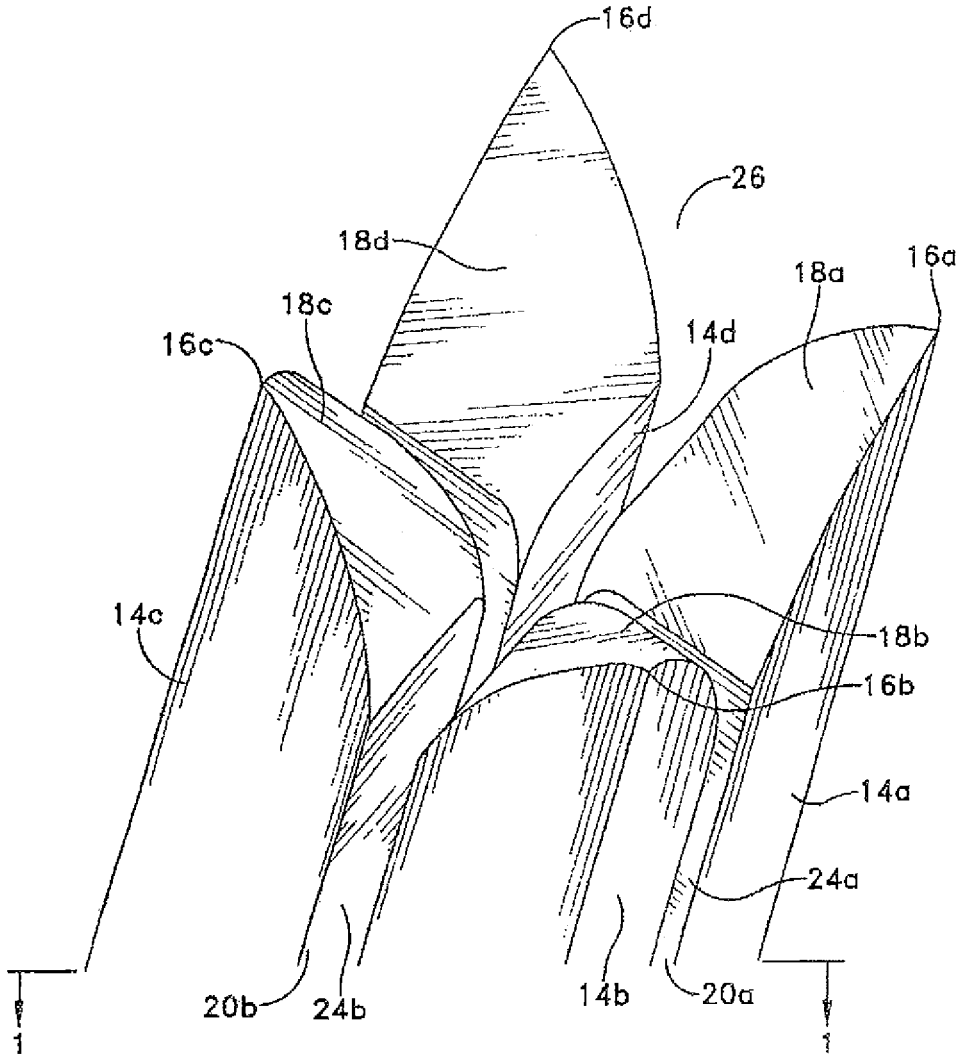
FIG. 3 is an exploded perspective view of the yard bag clip bottom.

Description—FIG. 1 and FIG. 3

A typical embodiment of my yard bag clip is illustrated in FIG. 1 and FIG. 3 and is generally designated 8. The clip 8 has a cylindrical shape from top 10 to bottom 26. The top 10 of the clip 8 is round. There are two cross-sectional cuts 20*a* and 20*b* beginning at the bottom 26 of the clip 8, forming four symmetrical legs 14*a*, 14*b*, 14*c*, and 14*d*. These cross-sectional cuts 20*a* and 20*b* are at 90° angles to one another forming two leg spaces 24*a* and 24*b*. The end of the cross-sectional cuts 22 forms a union between the body 12 and the legs 14*a*, 14*b*, 14*c*, and 14*d*. Each of the four legs 14*a*, 14*b*, 14*c*, and 14*d* has a convex radius 18*a*, 18*b*, 18*c*, and 18*d* starting from the leg points 16*a*, 16*b*, 16*c*, and 16*d* and curving convexly toward the inner part of the legs 14*a*, 14*b*, 14*c*, and 14*d*.

The diameter of the clip 8 is typically 18.0 mm to 19.5 mm and the length is typically 152.0 mm to 154.0 mm. The length of the legs 14*a*, 14*b*, 14*c*, and 14*d* are typically 120.0 mm to 122.0 mm from the end of the cross-sectional cuts 22 to the leg points 16*a*, 16*b*, 16*c*, and 16*d*.

In the preferred embodiment, the clip 8 is a durable plastic, such as impact styrene, or polyethylene, available from numerous U.S. plastic manufacturers. However, other similar plastics can be used, such as polypropylene, ABS, or recycled plastics.

Figure 2:
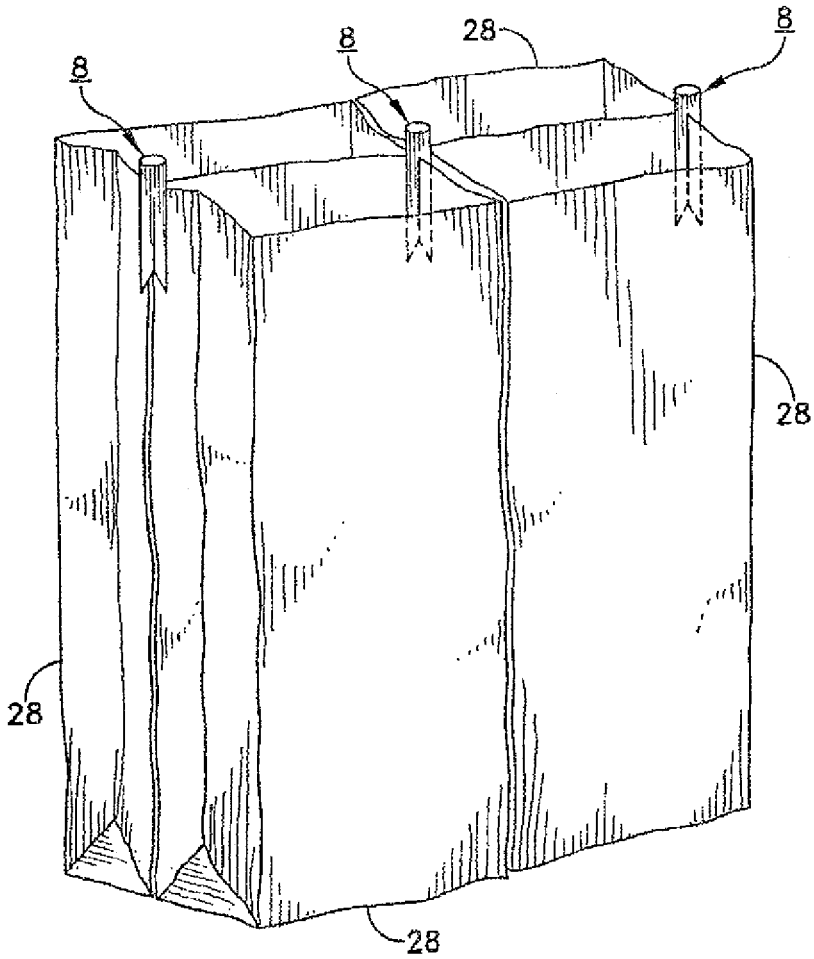
FIG. 2 is a perspective view of three clips in operative relationship to a group of four paper yard bags.

Operation—FIG. 2

The manner of using the clip 8 is simple, convenient, and efficient. Namely, one first opens as many paper yard bags 28 as desired and stands them up next to one another. Two or more bags 28 can be organized in a number of combinations such that they are standing right-side up, and the adjacent edges and corners are aligned. Next, each group of either two or four corners is held with one hand. With the other hand, the clip 8 is grasped at the body 12 and inserted, bottom 26 first, over the group of corners. The clip 8 is then slid down until the end of the cross-sectional cuts 22*a* and 22*b* meets the bag 28.

The convex radii 18*a*, 18*b*, 18*c*, and 18*d* serve a very important purpose. A group of paper yard bag 28 corners will enter at the bottom 26 of the clip 8, and the convex radii 18*a*, 18*b*, 18*c*, and 18*d* will then guide the corners into the leg spaces 24*a* and 24*b* quickly, easily, and without interference or interruption. Since the leg spaces 24*a* and 24*b* are much narrower than the opening at the bottom 26 of the clip 8, the bags 28 are held firmly in place. This process is repeated until all the desired bags 28 are secured. The group of bags 28 now have maximum openings for efficient filling and with insignificant set-up time.

CONCLUSIONS, RAMIFICATIONS, AND SCOPE OF INVENTION

Accordingly, the reader will see that the yard bag clip provides a highly reliable, lightweight, easy-to-use, and economical device that can be used by persons of almost any age. It can be removed from the paper yard bags just as easily, without damage to the bag, and can be reused many more times. It's a very simple solution to a troublesome and time-consuming task.

Although the description above contains many specificities, these should not be construed as limiting the scope of the yard bag clip but as merely providing illustrations of some of the presently preferred embodiments thereof. For example, the yard bag clip can have other shapes, such as oval, or rectangular. It can be of different length and diameter, it can have rounded leg points, and the convex radii can curve differently, all without departing from the spirit of the invention.

Thus the scope of the yard bag clip should be determined by the appended claims and their legal equivalents, rather than by the examples given.

What I claim as new and desire to protect by Letters Patent is:

1. A paper yard bag securing device, comprising (a) an elongated cylindrical shape of a body comprising four identical legs;

(b) a predetermined space between said legs sufficient for accommodating two, three or four corners of paper yard bags, said predetermined space being significantly smaller than that of a traditional cloths pin so that said paper trash bags are held securely one to another at their corners, whereby said corners of said paper trash bags are held securely to one another in upright position by means of a single leg inserted into each of said paper trash bags;

(c) said paper yard bag securing device being made of a material that is both durable and reusable; and, (d) a means of holding open the mouths of a plurality of said paper yard bags, so that the edges of said mouths of said bags are positioned adjacent to one another, and so that said mouths of said paper yard bags permit yard waste to fall into said paper yard bags when said yard waste is released from a position above said mouths, and allowed to fall by the force of gravity through said mouths of said paper yard bags, and into said yard bags.

2. A paper yard bag securing device as in claim 1, wherein, said paper yard bag securing device is manufactured of a plastic material, and at the same time inexpensively manufactured so that a user could choose to discard said paper yard bag securing device, if said user so elected.

* * * * *